US005653435A

United States Patent [19]

Yoneda

[11] Patent Number: 5,653,435

[45] Date of Patent: Aug. 5, 1997

[54] HEAT-SENSITIVE RECORDING MATERIAL FEEDING METHOD

[75] Inventor: Junichi Yoneda, Shizuoka, Japan

[73] Assignee: Fuji Photo Film Co., Ltd., Kanagawa, Japan

[21] Appl. No.: 581,194

[22] Filed: Dec. 29, 1995

[30] Foreign Application Priority Data

Jan. 25, 1995 [JP] Japan ..... 7-028664

[51] Int. Cl.[6] ..... B65H 1/00

[52] U.S. Cl. ..... 271/145; 355/72

[58] Field of Search ..... 271/145; 355/72, 355/73

[56] References Cited

U.S. PATENT DOCUMENTS

| | | | |
|---|---|---|---|
| 5,017,945 | 5/1991 | Sasai et al. | 346/136 |
| 5,038,934 | 8/1991 | Higashiyama | 355/72 |

FOREIGN PATENT DOCUMENTS

| | | | |
|---|---|---|---|
| 57-39411 | 8/1982 | Japan | G03C 3/00 |
| 0036034 | 2/1984 | Japan | 271/145 |
| 0036035 | 2/1984 | Japan | 271/145 |
| 0048335 | 3/1984 | Japan | 271/145 |
| 59-43743 | 3/1984 | Japan | 271/145 |
| 3-106734 | 5/1991 | Japan | 271/145 |
| 3-134658 | 6/1991 | Japan | G03C 3/00 |
| 6-92498 | 4/1994 | Japan | B65H 3/45 |
| 6-127720 | 5/1994 | Japan | 271/145 |

*Primary Examiner*—H. Grant Skaggs

*Attorney, Agent, or Firm*—Sughrue, Mion, Zinn, Macpeak & Seas

[57] ABSTRACT

A method for automatically feeding a heat-sensitive recording material in a heat-sensitive recording device, including storing the heat-sensitive recording material in a closed tray or magazine conditioned at a relative humidity of 35 to 85% and then feeding the heat-sensitive recording material. This method prevents deterioration of image quality due to environmental change (humidity change) and feeding troubles without enlarging the system.

7 Claims, 3 Drawing Sheets

HEAT-SENSITIVE RECORDING MATERIAL FEEDING METHOD

FIELD OF THE INVENTION

This invention relates to a heat-sensitive recording material feeding method, particularly a feeding method which prevents deterioration of image quality due to environmental changes and feeding troubles.

BACKGROUND OF THE INVENTION

Since heat-sensitive recording materials are highly reliable and free of maintenance in spite of their low cost and the simpleness of the recording device using them, they have recently been utilized in various fields such as facsimiles and printers. However, the heat-sensitive recording materials undergo variations in physical properties or recording characteristics with a change of their water content. That is, heat sensitivity on recording and the image density vary depending on the extent of exposure to the outer environment, especially high or low humidity, before recording. Further, the environmental change tends to make the recording material fail to be fed smoothly by means of a paper feed system.

It has been proposed to use a light-screening and/or moistureproof packaging material for packing recording materials susceptible to the influences of the outer environment so as to exclude the outer influences as disclosed, e.g., in JP-B-57-39411 (the term "JP-B" as used herein means an "examined published Japanese patent application") and JP-A-3-134658 (the term "JP-A" as used herein means an "unexamined published Japanese patent application"). However, the recording materials are unavoidably exposed to the outer temperature and humidity after being taken out of the package and loaded on a recording device until recording.

The adverse influence of the outer environment is the problem not only for heat-sensitive recording materials per se but for light-sensitive materials and for paper feed systems in printers.

In order to solve the problem, JP-A-6-92498 proposes a paper feeder for a printer which eliminates paper feed troubles due to changes in temperature and humidity and a paper container to be used therein, in which a desiccator is used to keep the inside of a tray dry. However, the method is disadvantageous in that troubles caused by static electricity or dust tend to occur due to the low humidity and that the moistureproof mechanism is bulky, making it difficult to reduce the device in size.

Thus, none of the conventional techniques has brought about sufficiently satisfactory results.

The inventors of the present invention have conducted extensive studies in pursuit of further improved paper feed performance. As a result they have found that very satisfactory results can be reached by using a tray fitted with an opening-and-closing mechanism or by putting a roll of a heat-sensitive recording material into a magazine and conditioning the inside of the tray or the magazine at a relative humidity (RH) of 35 to 85%. The present invention has been completed based on this finding.

SUMMARY OF THE INVENTION

An object of the present invention is to provide a method for feeding a heat-sensitive recording material, which prevents deterioration of image quality due to environmental change (humidity change) and feeding troubles without enlarging the system.

The above object of the present invention is accomplished by a method for automatically feeding a heat-sensitive recording material in a heat-sensitive recording device, including storing the heat-sensitive recording material in a closed tray or magazine conditioned at a relative humidity of 35 to 85% and then feeding the heat-sensitive recording material.

DETAILED DESCRIPTION OF THE INVENTION

Figure 1:
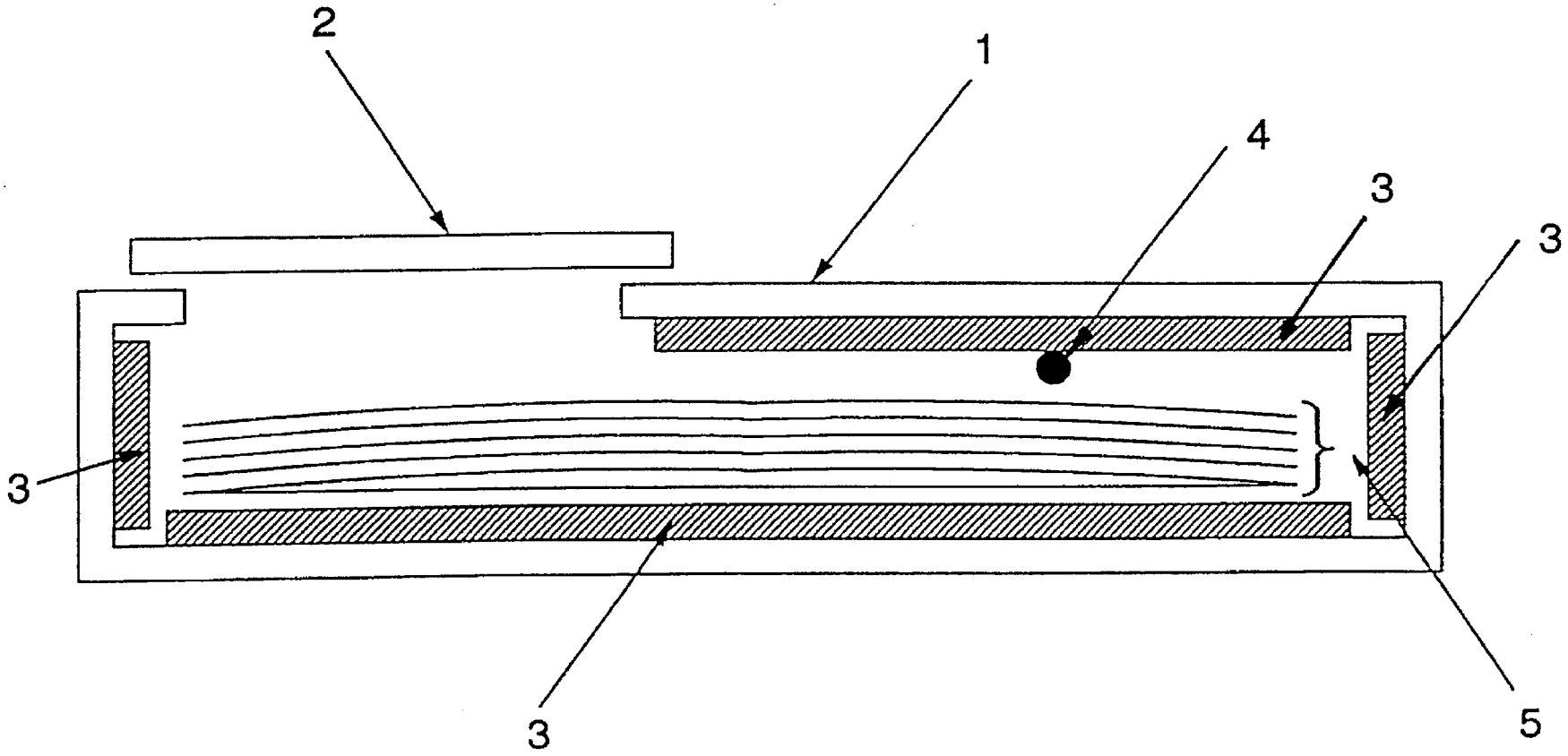
FIG. 1 is a cross section of an example of the humidity-controlled tray with a shutter according to the present invention.
Figure 2:
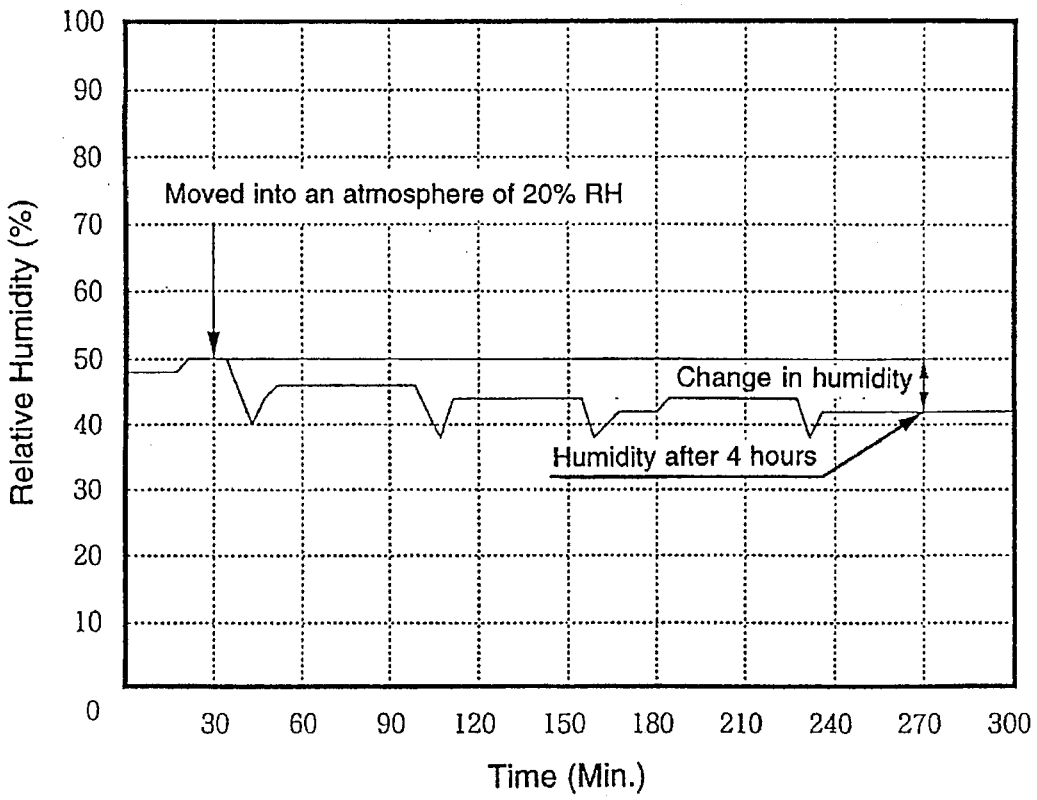
FIG. 2 is a graph showing the change in humidity inside tray A, which was prepared at 25° C. and 50% RH and moved into an atmosphere of 25° C. and 20% RH.
Figure 3:
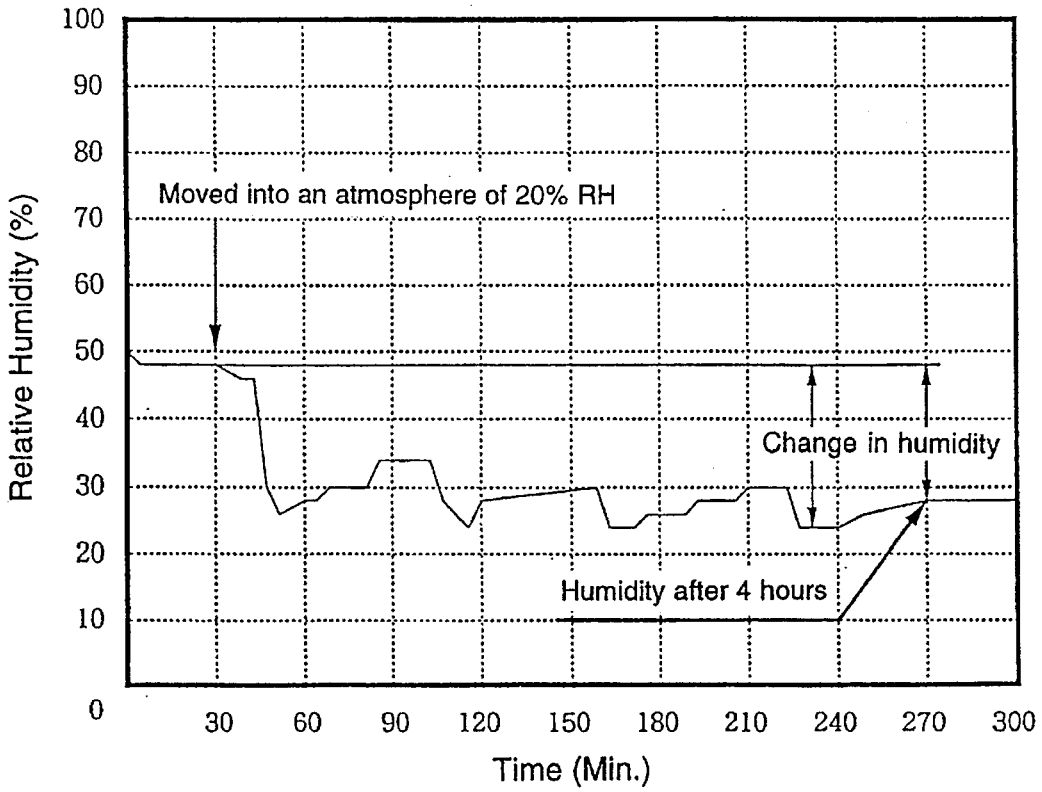
FIG. 3 is a graph showing the change in humidity inside tray B, which was prepared at 25° C. and 50% RH and moved into an atmosphere of 25° C. and 20% RH.
Figure 4:
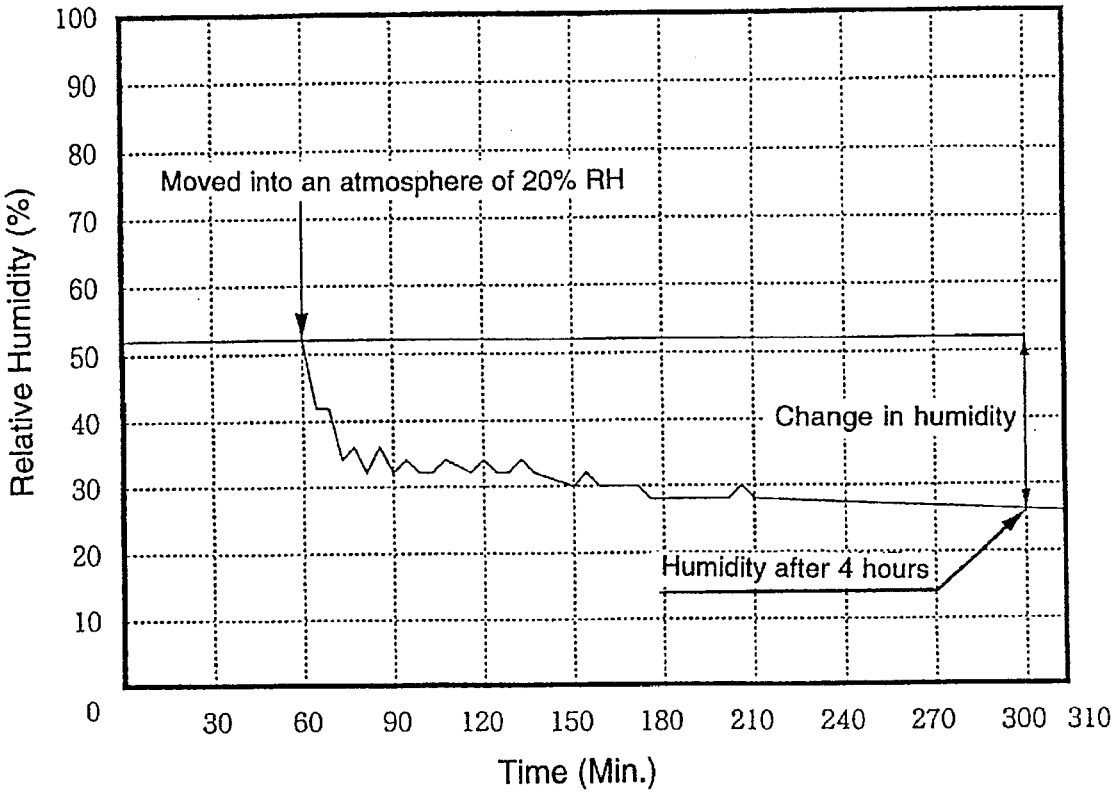
FIG. 4 is a graph showing the change in humidity inside tray C, which was prepared at 25° C. and 50% RH and moved into an atmosphere of 25° C. and 20% RH.
Figure 5:
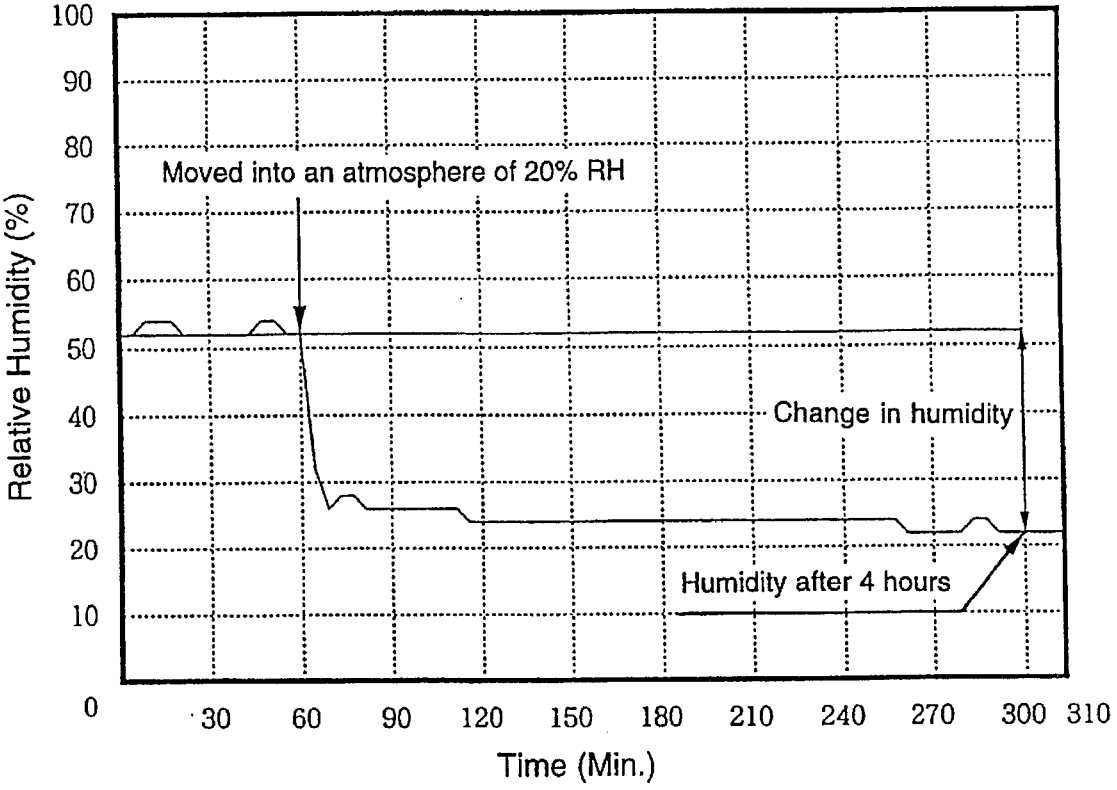
FIG. 5 is a graph showing the change in humidity inside tray D, which was prepared at 25° C. and 50% RH and moved into an atmosphere of 25° C. and 20% RH.

The heat-sensitive recording material which is applied to the present invention includes those conventionally known, such as those using a combination of a basic dye precursor and a developer as color forming components and those using a combination of a diazo compound and a coupler as color forming components. The heat-sensitive recording material may be in a sheet form or a roll Humidity conditioning of the inside of a tray or a magazine can be achieved by setting a humidity control material whose water content has been adjusted to a desired level in the tray or magazine and, where the humidity control material is set in the tray, providing the tray with a shutter which automatically opens and closes synchronously with paper feeding in such a manner that the shutter opens only at the time of feeding and is closed anytime else and, where the humidity control material is set in the magazine, narrowing the slit width of the magazine outlet or providing a blade made of soft material such as rubber at the magazine outlet so that the magazine has little ventilation.

The humidity condition of the inside of a tray or a magazine is at a relative humidity of 35 to 85%, and preferably 35 to 60%.

The humidity control material which can be used in the present invention is not particularly limited as long as it has humidity controlling action and includes commercially available humidity control materials (such as SHC Paper produced by Tokushu Paper Mfg. Co., Ltd. and Nikka Sheet HC produced by Nihon Kassei Hakudo Co., Ltd.) and, in addition, paper such as filter paper, wood such as paulownia wood, and cellular concrete.

These humidity control materials release moisture when the outer humidity is lower than the humidity inside the tray or magazine and absorb moisture when the outer humidity is higher than the humidity inside the tray or magazine, thereby maintaining the inside humidity constant.

Therefore, the tray or magazine should be in a substantially closed state while heat-sensitive recording paper is not fed. In particular, in the case of using a tray, which has a wide opening, a shutter capable of opening only at the time of paper feed to provide a wide opening sufficient for smooth paper feed is preferably provided at the outlet for feeding paper. In this case, the opening movement of the shutter provided on the tray should be synchronized with the movement of a paper feeding roller and a roller for picking up the recording material.

According to the heat-sensitive recording material feeding method of the present invention, since the humidity inside a tray or a magazine is stabilized regardless of the change in outside humidity, recording characteristics of the recording material, such as heat sensitivity and image density, as well as paper feed performance of the recording device are scarcely influenced by the outside environment.

The present invention will now be illustrated in greater detail by way of Examples, but it should be understood that the present invention is not limited thereto. Unless otherwise indicated, all parts, percents, ratios and the like are by weight.

EXAMPLE 1

As is shown in FIG. 1, an aluminum tray 1 (length: 34.5 cm; width: 26.0 cm; height: 3.4 cm; Capacity: 3,050 $cm^3$) with a shutter 2 fitted thereon was prepared. Humidity control material 3 was adhered to the inner sides of the tray. The opening of the shutter had an area of 14×26 $cm^2$. The humidity control material used was prepared by sufficiently conditioning 240 g of SHC Paper (3 mm thick paperboard produced by Tokushu Paper Mfg. Co., Ltd.) at 25° C. and 50% RH. The thus prepared tray was designated as tray A.

For comparison, trays designated B, C and D were prepared in the same manner as tray A, except that tray B contained no humidity control material, tray C was of an open type with no shutter but with humidity control material, and tray D was an ordinary open type tray with no shutter and no humidity control material.

A temperature and humidity sensor 4 was fitted to the inside of each tray so that any change in temperature and humidity might be monitored, and 10 sheets of fixing type heat-sensitive recording film 5 (produced by Fuji Photo Film Co., Ltd.) were set in the tray.

All the above preparation of trays was conducted at 25° C. and 50% RH. The trays were moved into an atmosphere of 25° C. and 20% RH, and the change in inside humidity was monitored. While in the atmosphere of 20% RH, the shutter of trays A and B was left open 4 times each for 7.5 minutes. The total opening time corresponds to the time required for feeding 120 sheets, assuming that feeding of one sheet takes 15 seconds.

The inside humidity of each tray after 4 hours from the movement into an atmosphere of 25° C. and 20% RH was as shown in FIGS. 2–5 (corresponding to trays A, B, C and D, respectively) and Table 1 below.

TABLE 1

| | Tray | Shutter | Humidity Control Material | Change in Inside Humidity After 4 Hrs. | Change* in Image Density |
|---|---|---|---|---|---|
| Invention | A | fitted | fitted | 10% or less | 0.10 or less |
| Comparison | B | fitted | not fitted | 20 to 25% | 0.20 to 0.22 |
| Comparison | C | not fitted | fitted fitted | 25 to 30% | 0.22 to 0.25 |
| Comparison | D | not fitted | not fitted | 30% | 0.25 |

Note: *Difference from the image density obtained in an atmosphere of 25° C. and 50% RH.

It was verified that the change in humidity inside the tray of the present invention was controlled as compared with the comparative trays and that the change in image density on the fixing type heat-sensitive recording material with the environmental change was also smaller in the present invention.

While the invention has been described in detail and with reference to specific embodiments thereof, it will be apparent to one skilled in the art that various changes and modifications can be made therein without departing from the spirit and scope thereof.

What is claimed is:

1. A method for automatically feeding a heat-sensitive recording material in a heat-sensitive recording device, comprising storing the heat-sensitive recording material in a closed tray or magazine conditioned at a relative humidity of 35 to 85% and then feeding the heat-sensitive recording material.

2. A method as in claim 1, wherein the heat-sensitive recording material is stored in a closed tray.

3. A method as in claim 2, wherein the tray is provided with a shutter which automatically opens and closes synchronously with paper feeding such that the shutter opens only at a time of feeding and is closed at all other times.

4. A method as in claim 1, wherein the heat-sensitive recording material is stored in a closed magazine.

5. A method as in claim 4, wherein the magazine has an outlet which is provided with a blade made of rubber.

6. A method as in claim 1, wherein the relative humidity is controlled by a humidity controlling material which is selected from the group consisting of paper, wood, and cellular concrete, wherein the paper, wood, and cellular concrete release moisture when humidity outside the tray or magazine is lower than that inside the tray or magazine and absorb moisture when humidity outside the tray or magazine is higher than that inside the tray or magazine.

7. A method as in claim 1, wherein the tray or magazine is at a relative humidity of 35 to 60%, with the relative humidity being controlled by a humidity controlling material which releases moisture when humidity outside the tray or magazine is lower than that inside the tray or magazine and which absorbs moisture when humidity outside the tray or magazine is higher than that inside the tray or magazine.

* * * * *